United States Patent [19]

Rantanen et al.

[11] Patent Number: 4,839,201

[45] Date of Patent: Jun. 13, 1989

[54] METHOD AND APPARATUS FOR APPLYING COATING LIQUID TO A MOVING BASE

[75] Inventors: Rauno Rantanen, Muurame; Markku Lummila, Jyväskylä, both of Finland

[73] Assignee: Valmet Paper Machinery Inc., Finland

[21] Appl. No.: 182,152

[22] Filed: Apr. 15, 1988

[30] Foreign Application Priority Data

Dec. 3, 1987 [FI] Finland ..... 875333

[51] Int. Cl.[4] ..... B05B 3/12; B05C 5/02; B05D 3/12

[52] U.S. Cl. ..... 427/355; 118/410; 118/413; 118/419; 427/356

[58] Field of Search ..... 118/410, 411, 413, 415, 118/419; 427/209, 355, 356, 358

[56] References Cited

U.S. PATENT DOCUMENTS 4,369,731 1/1983 Damrau ..... 118/410

4,452,833 6/1984 Holt ..... 427/356

4,702,196 10/1987 Kantzenberger ..... 118/410

*Primary Examiner*—Michael Lusignan

*Attorney, Agent, or Firm*—Steinberg & Raskin

[57] ABSTRACT

Method and apparatus for applying coating liquid onto a moving base, such as paper or board web, the surface of a counter-roll or the like wherein the coating liquid is fed under pressure into a coating liquid chamber of a coating device defined by a coating member, a front wall, edge seals and by a region of the moving base to be coated. In order to seal the front wall of the coating device against the passage of air with respect to the moving base and/or to lubricate the front wall and moving base with respect to each other, a fluid material, such as a liquid, dispersion, solution or the like is fed to an inlet side of the moving base region forward of the base region and front member in the direction of movement of the base so that the fluid material moves substantially parallel to and in the same direction as the moving base.

15 Claims, 5 Drawing Sheets

METHOD AND APPARATUS FOR APPLYING COATING LIQUID TO A MOVING BASE

BACKGROUND OF THE INVENTION

The present invention generally relates to methods and apparatus for the application and dosage of pressurized coating material onto a moving base. The moving base may comprise paper or board web in which case the invention relates to an improvement in coating techniques which are generally known in the paper industry.

The moving base may also comprise, for example, the surface of a roll of a size press. The coating applied to the roll surface is transferred onto the paper web passing through the size press in the gap between the press rolls. In this case, the invention relates to an improvement in surface-sizing techniques generally known in the paper industry.

More specifically, the present invention relates to a method for the application and dosage of a coating material onto a moving base, such as a paper or board web, the surface of a roll or counter-roll or the like wherein the coating material is fed under pressure into a coating material chamber of a coating device defined by a region of the moving base to be coated, a coating member extending substantially transversely with respect to the direction of movement of the base at one edge of the moving base region and a front member extending substantially transversely with respect to the direction of movement of the base at a front edge of the base region.

Additionally, the invention also relates more specifically to apparatus for carrying out the method of the invention including a coating device defining a coating material chamber of the type described above.

Conventional short-dwell units used, for example, in the coating of paper webs include arrangements in which coating material is fed under pressure into a coating chamber defined by a coating blade on the one hand, and by a front wall, e.g., a dam blade, on the other hand. A gap is formed between the front wall and the web to be coated. By feeding coating material into the coating chamber at a sufficiently high volumetric flow rate and pressure, an overflow or reverse flow, i.e. a flow in the direction opposite to the running direction of the web, takes place through the gap between the front wall of the web which functions to seal the gap so that air cannot penetrate into the coating chamber.

Conventional coating arrangements of this type are not entirely satisfactory. A coating device is disclosed in Finnish Pat. No. 61,534 in which the coating material is applied onto the base to be coated under pressure at a certain volumetric flow rate. When this arrangement is used in coating paper, it has been difficult to prevent the passage of air through the gap formed between the paper web and the front wall situated forwardly of the doctor blade or coating member of the coating device in the running direction of the web. The entry of air into the coating chamber has resulted in unevenness in the transverse profile of the coating applied to the web.

Although it is possible to prevent the entry of air into the coating chamber by tightly pressing the front member against the web, this has the effect of causing fibers and other impurities to be ground from the web into the coating chamber where they adhere to the coating blade resulting in blade streaks occuring in the coating. When the base being coated comprises a roll or rolls of a size press, excessive pressure between the front wall of the coating material chamber and the surface of the roll may cause wear damage in the roll surface since the impurities in the paper web tend to remain in front of the front wall due to the excessive pressure.

Another conventional arrangement for coating a moving base, and, in particular, a moving web is disclosed in U.S. Pat. No. 4,250,211. In this arrangement, the sealing of the front wall of the short-dwell unit with respect to the moving web to prevent passage of air through the gap formed between them is achieved by causing the coating material to flow through the gap in a direction opposite to the running direction of the web to completely fill the gap. Since the magnitude of the gap between the web and the front wall is typically in the range of between about 3 to 6 mm, a flow of coating material must typically be in the range of between about 20 to 30 times as large as the quantity of coating material that remains in the web in order to completely seal the gap. When the surface of a roll is being coated, the magnitude of the flow of coating material necessary to seal the gap, although being smaller than that required to seal the gap when coating web material, is still quite large as compared to the coating material layer that remains on the surface of the roll. When the gap is large, the pressure in the coating material chamber cannot be easily increased to a very high level, since the flow resistance through a large gap is quite low. Thus, if the pressure in the coating material chamber increases, the overflow or reverse flow through the gap correspondingly increases. If the gap size is reduced, for example to 1.5 mm, even small variations in the gap width caused, for example, by manufacturing defects, will manifest themselves as defects in the transverse profile of the coating layer. On the hand, in the case of gaps of reduced width, the pressure in the coating material chamber may become so high due to high flow resistance presented by the reduced gap, that problems in the sealing of the edges of the coating material chamber may result.

Attempts have been made to avoid the drawbacks of the arrangements of the type disclosed in U.S. Pat. No. 4,250,211 as discussed above through the use of coating devices in which the coating material is pressed within the region or zone of application of the web surface by means of hydrodynamic forces. In this connection, reference is made to the arrangements disclosed in U.S. Pat. No. 4,369,731 and German publication No. 3,338,095. It is, however, noted that in such arrangements, the hydrodynamic forces are utilized in the application area or zone of application of the coating material itself, so that it has still been necessary to pass a large overflow or reverse flow of coating material from the gap between the front wall of the application zone and the web to be coated in the inlet direction of the web.

SUMMARY OF THE INVENTION

It is an object of the present invention to provide new and improved methods and apparatus for applying a coating material onto a moving base.

Another object of the present invention is to provide new and improved methods and apparatus for applying coating liquid onto a moving base which avoids the problems and drawbacks of conventional methods and apparatus as discussed above.

Briefly, in accordance with the method of the invention, these and other objects are attained by providing a method wherein a fluid material is fed to an inlet side of the moving base forwardly of the front member in the direction of movement of the base so that the fluid material moves substantially parallel to and in the same direction as the moving base to thereby seal the front member against the passage of air with respect to the moving base and/or to lubricate the front member and moving base with respect to each other.

According to the apparatus of the invention, means are provided for feeding a fluid material to an inlet side of the moving base forward of the front member in the direction of movement of the base so that the fluid material moves substantially parallel to and in the same direction as the moving base to seal the front member against the passage of air with respect the moving base and/or to lubricate the front member and moving base with respect to each other.

Thus, according to the principles of the invention, coating material or some other fluid medium is fed forwardly of the front wall of the coating device so that the movement of the base to be coated produces and maintains a pool of the fluid medium ahead of the front wall. This provides several important advantages over the prior art arrangements. A flow fed in front of the front wall efficiently seals the gap between the front wall and the base to be coated so that access of air into the pressurized coating chamber is efficiently excluded. Since the sealing/lubrication flow that fills the gap between the front wall and the base to be coated is parallel to and in the same direction as the direction of movement of the base to be coated, the seal of the gap does not have a significant effect on the pressure in the coating material chamber. In accordance with the invention, the gap between the front wall and the base to be coated can be very narrow or even non-existent so that the pressure in the coating material chamber can be easily adjusted to the desired level without affecting the circulation of the coating material flow.

It is desired in some cases, such as when wood-containing paper of low strength is coated, to wash impurities from the coating member or blade by means of a high circulation flow of coating material. In accordance with the invention, this can be accomplished simply by feeding a higher proportion of the coating material forwardly of the front wall for sealing purposes so that an additional advantage relative to the prior art construction is obtained in that pressure in the coating material chamber remains substantially uniform and the resulting coating does not include steaks which is often the case when a large overflow or reverse flow is passed in a direction opposite to the direction of movement of the moving base to be coated.

DESCRIPTION OF THE DRAWINGS

A more complete appreciation of the present invention and many of the attendant advantages thereof will readily be understood by reference to the following detailed description when considered in connection with the accompanying drawings in which.

DETAILED DESCRIPTION OF THE PREFERRED EMBODIMENTS

Figure 2B:
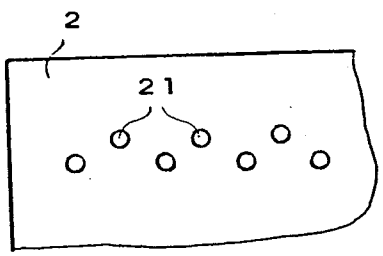
FIG. 2B is a fragmentary front elevation view of the front wall of the coating device shown in FIG. *2a;*
Figure 2A:
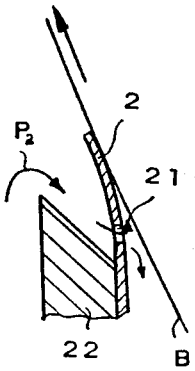
FIG. 2A is an enlarged detailed view of the feature designated II in FIG. 1.
Figure 1:
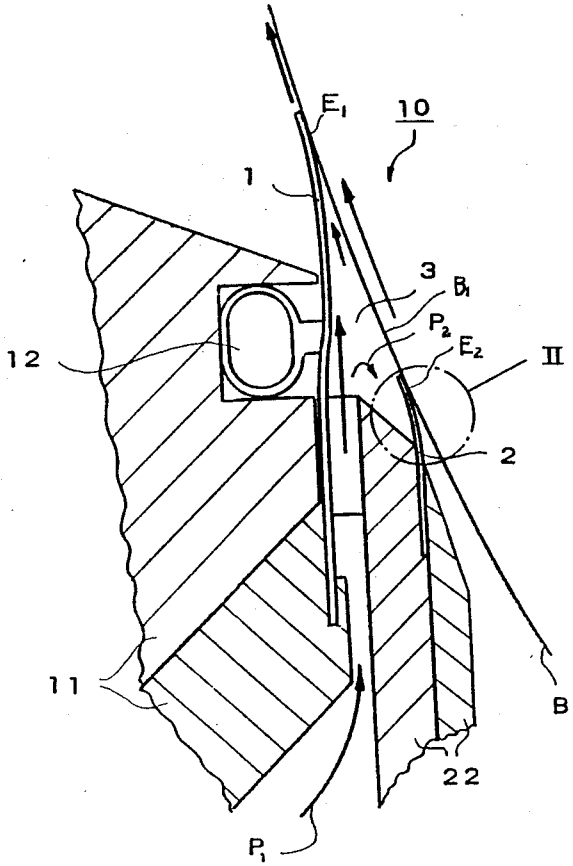
FIG. 1 is a side elevation view of one embodiment of apparatus in accordance with the invention in operation in accordance with the method of the invention.

Referring now to the drawings wherein like reference characters designate identical or corresponding parts throughout the several views, and more particularly, to FIGS. 1, 2A and 2B, coating apparatus in accordance with the invention is designated 10. Apparatus 10 includes a coating material chamber 3 defined by a region $B_1$ of the moving base B to be coated, a coating member 1 extending substantially transversely with respect to the direction of movement of the base B at one edge $E_1$ of the base region $B_1$ and a front member comprising a front wall 2 extending substantially transversely with respect to the direction of movement of the base at a front edge $E_2$ of the base region $B_1$ which is forward of the edge $E_1$. The chamber is also defined by lateral seals (not shown) located at transverse ends of the chamber. A coating material $P_1$ is fed under pressure and/or at desired volumetric flow rate into the coating material chamber 3. The coating member 1 of the embodiment of FIG. 1 comprises a conventional coating blade which is supported on the frame of the coating device by suitable supporting and fastening devices 11 provided with an inflatable hose 12 for adjusting the load applied by the coating member 1 to the moving base. In the running or inlet direction of the moving base B, the coating material chamber 3 is defined by the front wall 2 which is a flexible coating blade in the embodiment of FIGS. 1 and 2.

In order to improve the quality of the coating layer applied to the moving base B, access of air into the coating material chamber 3 must be prevented. In accordance with the invention, access of air into the coating material chamber 3 is prevented by passing a part of the supply flow $P_1$ of the coating material ahead of the front wall 2 so that this component flow $P_2$ functions as a sealing and/or lubrication flow for the front wall 2. In the embodiment illustrated in FIGS. 1 and 2, the sealing and/or lubricant flow $P_2$ is passed from the coating material chamber to a position in front of the front wall 2 through openings 21 formed through the front wall 2. The openings through which coating material may pass in front of the front wall may be located elsewhere such, for example, as in the supporting and fastening devices 22 of the front wall. The sealing and/or lubricant flow $P_2$ which is thus fed in front of the front wall 2 is then guided in the direction of run of the moving base B and fills the small gap between the front wall 2 and the moving base B to prevent access of air into the coating material chamber 3. Moreover, the sealing and/or lubricant flow $P_2$ also lubricates the edge of the front wall 2 situated contiguous with the moving base B and prevents leakage of the coating material from the chamber 3 through the gap between the front wall 2 and the moving base B to a position in front of the front wall 2.

Figure 3:
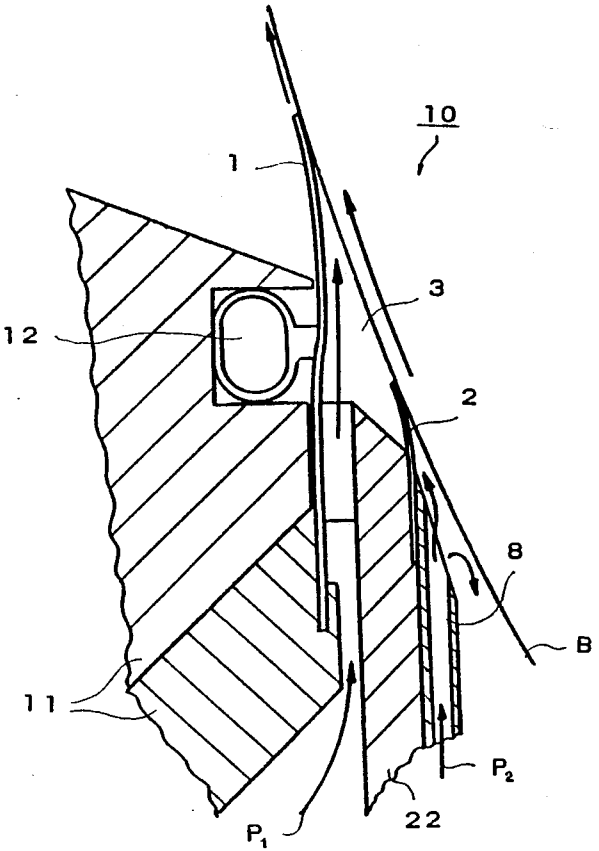
FIG. 3 is a side elevation view of a second embodiment of apparatus in accordance with the invention carrying out a method in accordance with the invention.

Referring now to the embodiment of FIG. 3, a second embodiment of a coating device 10 in accordance with the invention is illustrated. The embodiment of FIG. 3 differs from the embodiment of FIGS. 1 and 2 in that the front wall 2 is not provided with openings for the sealing and/or lubricant flow. Rather, in the embodiment of FIG. 3, the sealing and/or lubricant fbw $P_2$ is fed to a position in front of the front wall 2 as a separate flow and, for this purpose, a separate feeder device, such as a nozzle 8 or the like, is provided in front of the front wall 2. It is clear that the sealing of the front wall 2 in accordance with the embodiment of FIG. 3 may be accomplished by using a fluid substance other than the coating material $P_1$ fed into the coating material chamber 3. For example, the sealing and/or lubrication flow $P_2$ may comprise water or some other liquid, solution or dispersion or the like, by means of which the desired sealing and lubrication effect is obtained between the front wall and the moving base B. It is also possible to use a second coating material as the sealing and/or lubricant agent $P_2$ whose properties differ from the coating material $P_1$ fed into the coating material chamber 3. In such case, the surface of the moving base B can be provided with two coating material layers if desired. Of course, it is also possible in the embodiment of FIG. 3 to use the same coating material for the sealing and/or lubricant flow $P_2$ as that fed into the coating material chamber 3.

Figure 4:
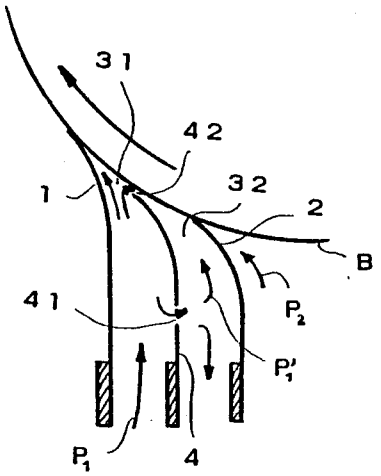
FIG. 4 is a schematic side elevation view of another embodiment of the invention.

Referring now to FIG. 4, another embodiment of the invention is illustrated which is similar to the previously described embodiments except that the coating material chamber defined by the coating member 1 and the front wall 2 is divided by a partition wall 4 into a first chamber 31 between the coating member 1 and the partition wall 4, and a second chamber 32 between the partition wall 4 and the front wall 2. The partition wall 4 may have two functions. Firstly, it may provide the coating material with a hydrostatic pressure pulse which promotes the formation of a uniform coating profile, especially with large quantities of coating material. Secondly, it is also possible if desired to use a high circulation flow for the coating material since part of the bypass flow can be passed out from the second pressure chamber 32. In particular, in the embodiment of FIG. 4, the feed flow $P_1$ of coating material is passed into the first chamber 31. A component $P_1'$ of the feed flow $P_1$ is suitably passed into the second chamber 32 which may or may not be pressurized. The component flow $P_1'$ may be passed into the second chamber 32, for example, through the gap 42 between the moving base B and the partition wall 4, in which case the component flow $P_1'$ flows in a direction opposite to the running direction of the moving base B, or may pass through openings 41 or the like formed in the partition wall 4. It is also possible to pass the component flow $P_1'$ into the second chamber 32 from the first chamber 31 through both the openings 41 and through the gap 42.

The arrangement may also be reversed by providing the feed flow $P_1$ of coating material into the second pressure chamber 32 from which a component flow $P_1$ is passed into the first chamber 31, which may or may not be pressurized through the gap 42 and/or through the openings 41. In this case, the circulation is obtained from the first chamber 31.

In the embodiment of FIG. 4, the sealing and lubrication between the front wall 2 and the moving base B is arranged so that a sealing and/or lubricant flow $P_2$ is passed in front of the front wall 2, such as in the manner shown and described above in connection with FIG. 3, although it is possible to use an arrangement in accordance with FIGS. 1 and 2 in the embodiment of FIG. 4.

Figure 5:
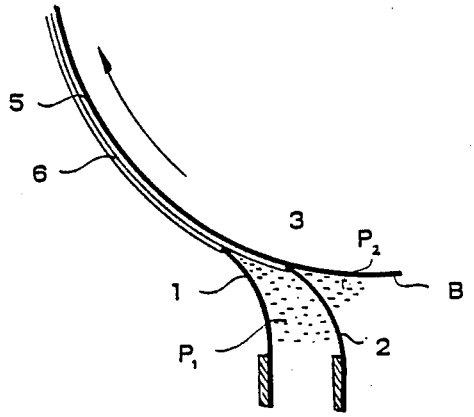
FIG. 5 is a schematic side elevation view of another embodiment of the invention.

Referring to FIG. 5, an embodiment of the invention is illustrated by which two coating layers are applied to the same surface of the moving base B and to which reference was made in connection with the description of the embodiment of FIG. 3. A coating material flow $P_1$ is fed into the coating material chamber 3 defined by the coating member 1 and front wall 2 as described above. The sealing and/or lubricant flow $P_2$ is fed in front of the front wall 2 and also consists of a coating material whose properties may differ from those of the coating material of flow $P_1$. In this embodiment, two layers of coating materials are thus applied onto the moving base B, the first coating layer consisting of the coating material used as the sealing and/or lubricating agent $P_2$ and the second coating layer 5 consisting of the coating material $P_1$ fed into the coating material chamber 3. In this embodiment, the gap defined between the front wall 2 and moving base B is, of course, of a size suitable to permit a controlled flow of the sealing and/or lubricating agent through the gap into the coating material 3.

The embodiments of FIGS. 1–4 may also differ from that of FIG. 5 in that the coating material $P_1$ fed into the coating material chamber 3 of the embodiments of FIGS. 1–4 is not recirculated but is used in its entirety to form the coating material layer on moving base B. In such a case, the sealing and/or lubricating flow $P_2$ fed in front of the front wall 2 is used only in order to seal the gap between the front wall 2 and the moving base B to prevent air from entering into the coating material chamber 3.

Figure 6:
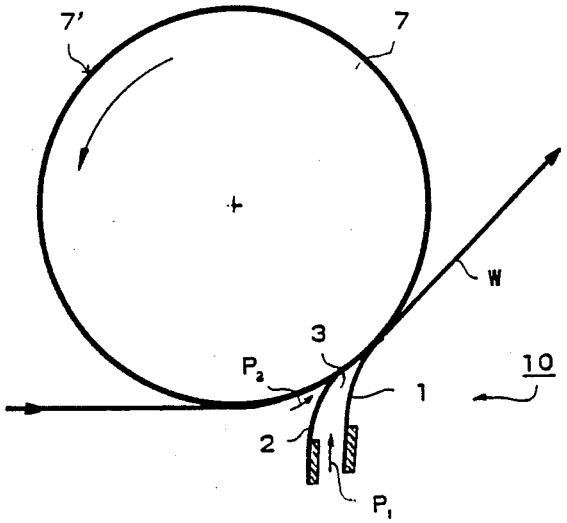
FIG. 6 is a schematic side elevation view illustrating the application of coating material in accordance with the invention directly onto the surface of a web.

Referring now to FIG. 6, an embodiment of the invention is illustrated in which the moving base B comprises a paper or board web W or the like which is passed over a counter-roll 7 and the coating is applied directly onto the surface of web W. The coating device 10 is supported against the surface of web W with the coating member 1 and face 7' of the counter-roll 7 defining a coating nip through which the web W is passed. The coating material and sealing and/or lubricating material are fed as flows $P_1$ and $P_2$ in any of the ways described above.

Figure 7:
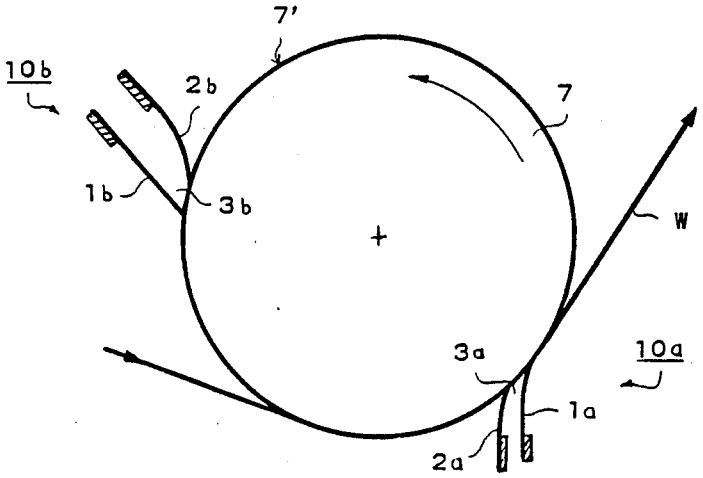
FIG. 7 is a schematic side elevation view illustrating the application of coating liquid on two sides of a web in accordance with the invention.

Referring to FIG. 7, an embodiment of the invention is illustrated in which both sides of a moving web W are coated. The web W passes over a counter-roll 7 with one side of the web W being coated by means of coating device 10*a* comprising a coating member 1*a*, a front wall 2*a* and a coating material chamber 3*a* defined by them. Thus, the coating device 10*a* applies the coating material directly onto one side of the web W. A second coating device 10*b* is provided to spread size onto the surface of the counter-roll 7. The second coating device 10*b* also comprises a coating member 1*b*, a front wall 2*b* and a coating material chamber 3*b* defined by them whose operation and construction have been described above in connection with the previously described embodiments of the invention. The second coating device 10*b* spreads size over the surface of roll 7' which in turn carries the size to the web W where it adheres to the other side of web W.

Figure 8:
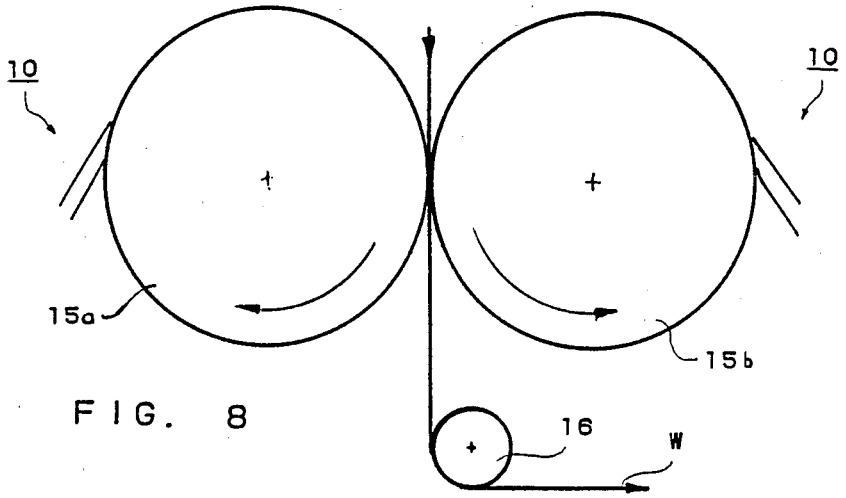
FIG. 8 is a schematic side elevation view of the application of a method and apparatus in accordance with the invention to a size press.

Referring to FIG. 8, an application of the invention in connection with the operation of a size press is illustrated. A web W to be coated is passed through a nip formed between size press rolls 15*a* and 15*b* in a conventional manner and then passes over a tension roll 16. According to the invention, the coating material, e.g., size, is spread onto the surface of at least one of rolls 15*a*, 15*b* of the size press by means of a coating device 10 in accordance with the invention. In the embodiment of FIG. 8, the coating material is spread onto the surfaces of both the rolls 15*a* and 15*b* in accordance with the invention. The coating material is carried on the surface of the size roll to the web and adheres to the surface of the web W.

Figure 9:
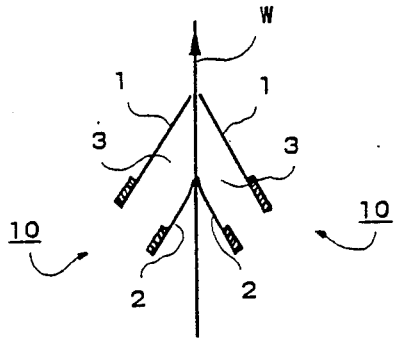
FIG. 9 is a schematic side elevation view illustrating the invention used in two-sided coating directly onto the web surfaces.

An embodiment of the invention is illustrated in FIG. 9 in which the web W is coated on both of its sides by means of coating devices 10 situated at both sides of the web W. The coating devices 10 are preferably situated in a symmetrical manner and define a nip through which the web W passes. Coating material and sealing and/or lubricating agents are fed into the coating devices 10 of this embodiment in any one of the ways described above in connection with the previously discussed embodiments.

In all of the embodiments described above, the coating member 1 has been, for example, a conventional doctor blade, plate or flexible blade while the front wall 2 has comprised a corresponding member. It is to be noted that depending upon the particular application, the front wall may be positioned in any suitable position and the angle of the blade used as the front wall 2 relative to the base B to be coated may vary, for example, between about 0° and 180°.

Figure 10:
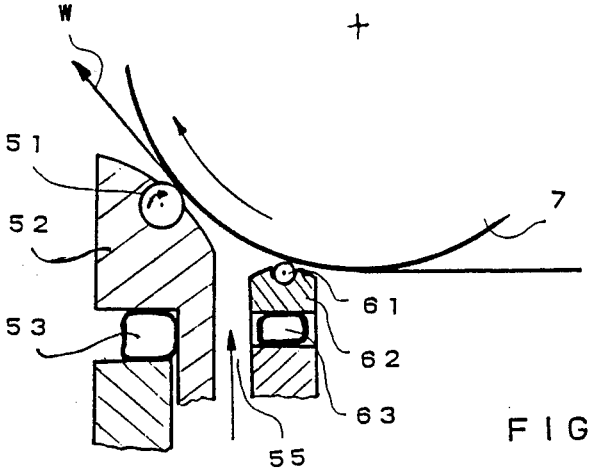
FIG. 10 is side elevation view of another embodiment of the invention.

It is to be understood, however, that the coating member and front wall need not necessarily be constituted by blades or similar members. For example, referring to FIG. 10, an embodiment of the invention is illustrated in which a rotatably mounted rod 51 comprises the coating member, the rod 51 being supported on the frame of the coating device by a support member 52 and by a loading hose 53. Alternatively, it is possible to use, for example, a smooth, round rod, a rod provided with circumferential grooves, a profiled bar, or a grooved blade or the like as the coating member. In the same manner, a round bar 61 comprises the front wall defining the coating material chamber 55. The bar 61 is supported on the frame of the coating device by support means 62 and loading hose 63. It is also possible to use a rod provided with circumferential grooves, a profiled bar, or the like as the front wall.

In the embodiments described above, the coating material $P_1$ is fed into the coating material chamber 3, for example, by means of hydrostatic pressure or by means of a separate pump or the like. The coating material $P_1$ may be fed into the coating material chamber 3 as a volumetric flow at a desired rate, or, alternatively, the pressure in the coating material chamber 3 can be adjusted to a desired level, such, for example, as by adjusting the feed quantity of the coating material $P_1$. In such case, the rate at which the coating material is fed into the coating material chamber is chosen so that the ratio between the recirculating return flow from the coating material chamber 3 and the coating material being used to form the actual coating is, for example, within the range of between about 0 to 50. The pressure in the coating material chamber 3 may also be adjusted such, for example, as by adjusting the loading pressure of the coating member 1 against the moving base B. The loading pressure of the coating member 1, 51 can be adjusted, for example, either mechanically or by means of loading hoses of the type exemplified by loading hoses 12, 53 of FIGS. 1, 3 and 10. The distance of the front wall 2, 61 from the moving base B, W is also preferably arranged so as to be adjustable, either mechanically or by means of a loading hose, such as loading hose 63 of FIG. 10. As already noted, conventional coating materials, size or a pigment coating paste can be used as the coating material in accordance with the invention.

Figure 12:
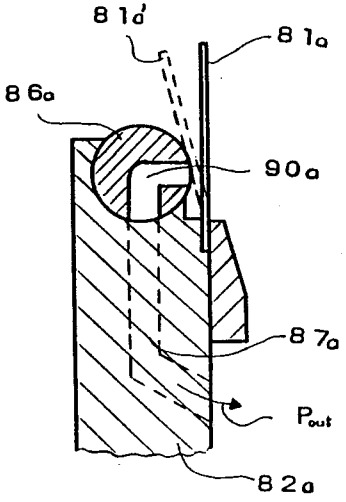
FIG. 12 is a side elvation view of another embodiment of the apparatus which also includes means for preventing leakage of the coating material when the coating unit is in an open position.
Figure 11:
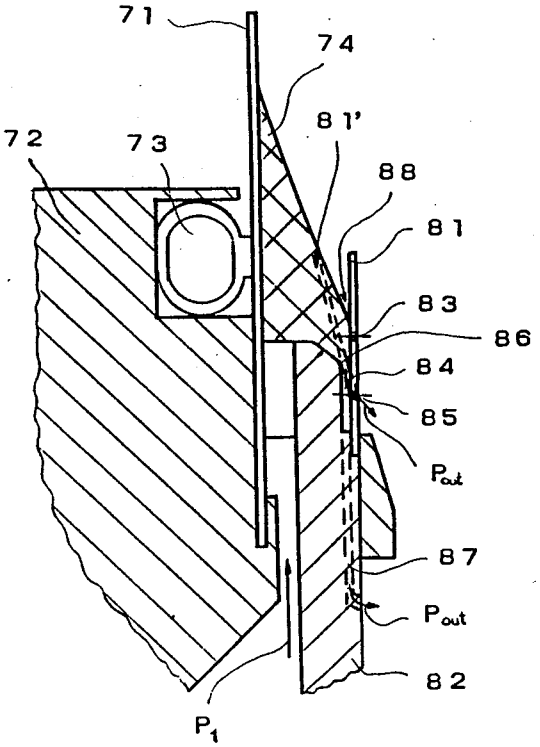
FIG. 11 is a side elevation view of another embodiment of the invention including means for preventing leakage of the coating when the coating device is in an open position.

Referring now to FIGS. 11 and 12, additional embodiments of the invention are illustrated which are provided with means for preventing leakage of coating material from the coating device when the latter is moved to its open position, i.e., when the coating device has been withdrawn from contact with the moving base to be coated. When in the open position, the coating member 71, e.g., a doctor, and the front wall 81, e.g., a dam blade, are straight.

In the embodiment of FIG. 11, the coating member 71 is mounted in support and fastening means 72 and a loading hose 73 and edge seals 74 are shown. The front wall 81 is attached to support and fastening means 82 in the conventional manner. Openings 83 are formed in the front wall 81 in a manner similar to openings 21 in the embodiments of FIGS. 1 and 2 through which the lubricating and sealing flow passes from the coating material chamber to the front side of the front wall 81. When the coating device is in its open position, leakage of the coating material is possible from the coating material chamber past the edge seals 74 through the base 88 between the edge seals 74 and the front wall 71. In the embodiment of FIG. 11, such leakage is prevented by providing a detector D which monitors the level of the coating material, such as by ultrasonic sound, in the coating chamber and provides measurement information by which the level of the coating material is adjusted by adjusting the quantity of the feed flow $P_1$ to an appropriate level so that any leakage or overflow takes place only through openings 83 formed in the front wall 81. It is noted that the openings 83 are situated at a lower level then the point of intersection of the edge seals 74 and the front wall 81, i.e., the lowermost point of the gap 88. In the embodiment of FIG. 11, the surface level of the coating material in the coating chamber is adjusted by the provision of ducts 84 between the support and fastening means 82 and the front wall 81. When the coating device is moved to its closed or operating position, the front wall 81 is deflected to the dotted line position 81' in which the front wall closes the ducts 84. In particular, the front wall 81 is pressed against a rounded upper edge 86 of the support and fastening means to form a seal therewith so that no coating material can flow between the upper edge 86 and the front wall 81'. When the coating device is in its open position, a sufficient amount of coating material can flow through the ducts 84 past the front wall 81 to maintain the surface level of the coating material at a sufficiently low level.

The coating material flow $P_{out}$ withdrawn from the coating chamber can be passed out of the coating chamber for recirculation in one of two alternate ways. Firstly, a second set of openings 85 can be provided in the front wall beneath the upper edge 86 of the support and fastening means through which the outflow $P_{out}$ of the coating material can flow to recirculation. Alternatively, grooves or ducts 87 may be provided in the support and fastening means 82 which extend beneath the wall 81 and which open from the support and fastening means 82 which extend beneath the front wall 81 and which open from the support and fastening means 82 to permit discharge of the outflow $P_{out}$ of coating material to recirculation. In accordance with these embodiments, the outflow $P_{out}$ of the coating material is discharged in a controlled manner to recirculation when the coating device is in the open position.

Referring now to FIG. 12, another embodiment of the invention provided with means for preventing leakage of the coating material from the coating chamber when the device is in its open position is illustrated. Only the front wall **81*a* and associated structure are shown in FIG. 12 for purposes of clarity. In its closed or operating position, i.e., when the front wall is placed against the base to be coated, the front wall assume the dotted line position 81*a'*. A bar 86*a* which extends in the width direction of the coating device is arranged at the upper edge of the support and fastening means 82*a*. Transverse openings 90*a* are formed through the bar 86*a* which communicate with ducts 87*a* formed in the support and fastening means 82*a* which at their other end open into a return circulation system for the coating material. The other sides of through-openings 90*a* open into the coating material chamber. When the front wall is in its closed position 81*a'* supported against the base to be coated, the front wall 81*a'* is pressed against the bar 86*a* to close the openings 90*a* in bar 86*a*. In this manner, no coating material can flow through the openings 90*a* during a coating operation. When the coating device is moved to its open position, the front wall moves to the position 81*a* thereby communicating openings 90*a* with the coating chamber whereby coating material flows out of the chamber into the openings 90*a* into the ducts 87*a*** to pass as an outflow $P_{out}$ of the coating material to recirculation. In this manner, the outflow $P_{out}$ is passed in a controlled manner to recirculation when the coating device is in the open position.

Experiments have been conducted comparing the operation of an arrangement in accordance with the invention to conventional short-dwell units. In such conventional short-dwell units, streaks in the coating profile having a width of about 2 cm generally occur. The formation of such streaks is typical of conventional short-dwell units particularly in the case where large coating quantities are used, i.e., on the order of about 10 to 15 g/m$^2$. When an arrangement in accordance with the invention was used, no streaks were formed at all. This is attributed to the fact that the sealing and/or lubricant fed in front of the front wall efficiently prevented the entry of air into the coating material chamber. The thickness of the lubricant layer was quite large and thereby obtained kinetic energy from the movement of the paper web thereby promoting the formation of a large, uniform coating quantity. At the same time, the hydrostatic pressure pressed coating material into the pores thereby priming and smoothing the coating adhering to the base to be coated. On the other hand, in the case where lubricating flow is pressed to a lesser thickness by urging the front wall against the base being coated to a greater extent, no significant increase in the coating quantity will occur. For example, when pigment coatings are used in conventional, short-dwell units, a significant number of rheology streaks occur in the coating since at high shearing speeds, the pigment coatings behave similar to solid matter so that the coating blade in effect crushes the coating material. The rheology steaks are thereby formed in the coating by the particles that remain in front of the coating blade. On the other hand, when an arrangement in accordance with the invention is used, no rheology streaks were formed due to the fact that the front wall of the coating device acts to align the particles in the pigment coating so that their orientation becomes parallel to the web, whereby the coating is readily applied. Thus, when pigment coatings are applied, the front wall permits so much paste to pass through that it runs as a laminar flow.

Conventional short-dwell units have the additional drawback that in order to operate efficiently, a very large circulation of coating material is required, e.g., a circulation of the order of 200 liters per meter of width of the base to be coated. However, normal size presses are usually not dimensioned to accommodate such a high circulation. It has therefore been the case that when used with size presses, the recirculation equipment used with the conventional short-dwell require redesign and reconstruction thereby increasing the cost of the arrangement. On the other hand, an arrangement in accordance with the invention operated efficiently in tests even with no recirculation of the coating material. Very good results were obtained when the circulation of the coating material was at a rate of about 20 liters per meter of width of the base to be coated. Moreover, it is noted that in the case of the invention, it is possible to use a very high circulation rate, i.e., on the order of about 200 liters per meter of width of the base to coated, if necessary.

An arrangement in accordance with the invention can be adapted for even more efficient use with size presses. Thus, in the operation of size presses, the film usually spreads to an area somewhat wider than the web resulting in the possibility that size may pass into the nip beyond the web. Using an arrangement in accordance with the invention, this can be prevented by providing separate doctors at the edges of the coating device immediately after the coating blade to scrape and clean the surface of the roll. The size scraped from the roll surface can then be passed on for recirculation. Such scraping may, of course, be carried out either from the roll surface itself, or directly from the paper web so that in this manner, the doctors operate as means for limiting the width of coating.

Spreading of the coating beyond the width of the web can also be prevented by feeding water to the locations facing the edge seals of the coating device. In the experiments carried out, it was noted that when the edge seals were sealed by feed water, the paste could not flow beyond the edge seals.

Obvously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for applying coating material onto a moving base, such as the surface of a paper or board web, a counter-roll, or the like, comprising the steps of:

feeding coating material under pressure into a chamber defined by a region of the moving base to be coated and a coating device, said coating device including a coating member extending substantially transversely with respect to the direction of movement of said base at one edge of said base region, and a front member extending substantially transversely with respect to the direction of movement of said base at a front edge of said base region forward of said one edge; and feeding a fluid material to an inlet side of said moving base region forward of said base region and front member in the direction of movement of said base so that said fluid material moves substantially parallel to and in the same direction as said moving base to seal said front member with respect to said moving base against the passage of air over said front edge of said base region and/or to lubricate said front member and moving base with respect to each other.

2. The method of claim 1 wherein said fluid material which is fed forward of said front member comprises a coating material.

3. The method of claim 1 wherein said fluid material feeding step includes passing a partial flow of said coating material from said chamber to said inlet side of said moving base region forward of said front member.

4. The method of claim 1 wherein said fluid material feeding step includes passing a flow of said fluid material which is separate from a flow of said coating material into said chamber to said inlet side of said moving base region forward of said front member.

5. The method of claim 1 wherein said fluid material which is fed forward of said front member comprises said coating material.

6. The method claim 1 including the further steps of, pre-coating the moving base by means of said fluid material fed to said inlet side of said moving base region forward of said front member; and forming a second coating on the pre-coating by means of said coating member.

7. The method of claim 1 wherein said step of feeding coating material into said chamber is carried out exclusively, by flowing said coating material through a gap formed between said front member and said moving base.

8. The method of claim 1 including the further steps of passing a return flow of said coating material from said chamber and recirculating the same.

9. The method of claim 1 wherein when said coating device is in an open position in which said member and said front member are out of contact with said moving base, the step of preventing leakage from said chamber by adjusting the level of said coating material in said chamber by providing an outflow of said coating material from said chamber and then recirculating said outflow coating material.

10. Apparatus for applying coating liquid onto a moving base, such as the surface of a paper or board web, a counter-roll or the like, comprising:

a coating chamber defined by a region of the moving base to be coated and a coating device, said coating device including a coating member extending substantially transversely with respect to the direction of movement of said base at one edge of said base region and a front member extending substantially transversely with respect to the direction of movement of said base at a front edge of said base region forward of said one edge;

means for feeding coating material under pressure into said coating chamber; and means for feeding a fluid material to an inlet side of said moving base region forward of said base region and front member in the direction of movement of said base so that said fluid material moves substantially parallel to and in the same direction as said moving base to seal said front member with respect to said moving ase to prevent the passage of air with respect to said moving base over said front edge of said base region and/or to lubricate said front member and moving base with respect to each other.

11. The combination of claim 10 wherein said means for feeding fluid material forward of said front member include means for passing a part of said coating material from said coating chamber forward of said front member.

12. The combination of claim 11 wherein said front member is mounted in support means and wherein said means for passing a part of said coating liquid from said coating chamber forward of said front member comprises openings formed through at least one of said front member and support means.

13. The combination of claim 10 wherein said means for feeding fluid material forward of said front member include nozzle means situated forwardly of said front wall for feeding a flow of fluid material, which is separate from a flow of said coating material into said coating chamber, forward of said front member.

14. The combination of claim 10 further including means for preventing leakage of coating material from said coating chamber when said coating device is in an open position in which said coating member and said front member are out of contact with said moving base.

15. The combination of claim 1 wherein said leakage preventing means include means for monitoring the level of coating material in said coating chamber and for creating an outflow of coating material from said coating chamber when said level exceeds a predetermined height and passing said outflow of coating material to recirculation means.

* * * * *